US011305440B2

(12) United States Patent
Demko

(10) Patent No.: US 11,305,440 B2
(45) Date of Patent: Apr. 19, 2022

(54) KNIFE WITH INTERCHANGEABLE BLADE

(71) Applicant: Cold Steel, Inc., Ventura, CA (US)

(72) Inventor: Andrew Demko, Wampum, PA (US)

(73) Assignee: GOOD SPORTSMAN MARKETING, LLC, Irving, TX (US)

( * ) Notice: Subject to any disclaimer, the term of this patent is extended or adjusted under 35 U.S.C. 154(b) by 0 days.

(21) Appl. No.: 16/798,386

(22) Filed: Feb. 23, 2020

(65) Prior Publication Data

US 2021/0197411 A1 Jul. 1, 2021

Related U.S. Application Data

(60) Provisional application No. 62/955,817, filed on Dec. 31, 2019.

(51) Int. Cl.
*B26B 1/04* (2006.01)
*B26B 1/06* (2006.01)

(52) U.S. Cl.
CPC ..... *B26B 1/046* (2013.01); *B26B 1/06* (2013.01)

(58) Field of Classification Search
CPC ... B26B 1/046; B26B 1/06; B26B 5/00–5/008
See application file for complete search history.

(56) References Cited

U.S. PATENT DOCUMENTS

| | | | | |
|---|---|---|---|---|
| 324,563 | A | 8/1885 | Koska | |
| 842,173 | A * | 1/1907 | Carman | B26B 5/00 279/77 |
| 1,018,210 | A | 2/1912 | Segel et al. | |
| 1,361,021 | A | 12/1920 | Copeman | |
| 1,500,402 | A | 7/1924 | Lewis | |
| 1,586,906 | A | 6/1926 | Lewis | |
| 1,813,723 | A | 7/1931 | Beaver | |
| 1,940,855 | A | 12/1933 | Friedman | |
| 1,998,188 | A | 4/1935 | Dunn | |
| 2,018,603 | A | 10/1935 | Case et al. | |
| 4,169,312 | A | 10/1979 | Mar | |
| 4,391,043 | A * | 7/1983 | Sizemore | B25G 3/18 30/330 |
| 6,701,626 | B2 | 3/2004 | Knoop | |
| 7,222,429 | B2 | 5/2007 | PerMar, Jr. | |
| 7,325,314 | B1 | 2/2008 | Chen | |
| 7,469,476 | B2 * | 12/2008 | Demko | B26B 1/042 30/160 |
| 2002/0000042 | A1 * | 1/2002 | Glesser | B26B 1/044 30/160 |
| 2017/0266821 | A1 * | 9/2017 | Cheng | B25G 3/16 |
| 2017/0348863 | A1 | 12/2017 | Kommer et al. | |

FOREIGN PATENT DOCUMENTS

| | | |
|---|---|---|
| FR | 2876940 | 10/2004 |

OTHER PUBLICATIONS

Leap User Guide, Leatherman Tool Group, Inc., 2014.

* cited by examiner

*Primary Examiner* — Stephen Choi
(74) *Attorney, Agent, or Firm* — William F. Lang, IV; Lang Patent Law LLC

(57) ABSTRACT

A knife includes interchangeable blades that are secured within the handle using a locking mechanism having a lock pin disposed between the distal end of the lock bar and the blade. In addition to strengthening the lock, the lock pin also serves as a safety catch n the unlikely event of lock failure, resisting rotation of the blade into a position in which the user's fingers would be cut.

1 Claim, 10 Drawing Sheets

KNIFE WITH INTERCHANGEABLE BLADE

CROSS REFERENCE TO RELATED APPLICATION

This application claims the benefit of U.S. provisional patent application Ser. No. 62/955,817, which was filed on Dec. 31, 2019, and entitled "Knife With Interchangeable Fixed Blade."

TECHNICAL FIELD

The present invention relates to blade knives with interchangeable blades. More specifically, a knife having a blade retaining mechanism with increased strength as well as a safety catch is provided.

BACKGROUND INFORMATION

Different blade configurations are useful for different purposes. Knife users who may need a variety of different blade configurations for different tasks must either carry multiple knives, or have a means of changing the blade on the knife they carry. Although fixed blade knives having interchangeable blades are known, one of the principal reasons for selection of a fixed blade is the strength provided by a knife with a blade that does not move relative to the handle. Thus, making the blade interchangeable using a prior method is contrary to one of the main advantages of a fixed blade knife.

An example of a previously proposed knife is disclosed by U.S. Pat. No. 324,563, describing a handle for a knife. The handle includes a pivotally secured catch that is held in a closed position by a leaf spring. The end of the catch Up us at the leaf spring includes a protrusion having a rear facing perpendicular surface, and a forward facing angled surface. The knife blade includes a corresponding notch. Sliding the shank into the handle will cause the shank to push upward on the catch, until the notch aligns with the protrusion and the blade is held within the handle. Depressing the end of the catch adjacent to the leaf spring separates the protrusion from the notch, permitting removal of the blade.

U.S. Pat. No. 842,173 discloses a tool holder. The tool holder includes a handle having an L-shaped frame with a pair of plates secured thereto. In auxiliary frame piece is secured to the front end of the handle, opposite the L-shaped frame, forming an opening there between for receiving the shank of a tool. The end of the shank includes a notch that is structured to receive a detent carried by the forward end of a locking lever. The locking lever is perfectly secure between the side plates. The opposite end of the locking lever is cut away to formal ledge, which engages with the end of the free member to limit upward movement of the locking arm. The locking lever also includes a groove for receiving the end of a spring to bias the locking lever into a closed position. Depressing the locking lever permits removal of the blade or other tool.

U.S. Pat. No. 1,018,210 discloses a tool. The tool includes a shank having a reduced with and a beveled end. The junction between the reduced portion of the shank in the main portion is concave, and continues upwardly to form a vertical projection having a convex outer face. A notch is disposed between the projection and the inner Edge of the tool blade. A spring biased lever is used to retain the shank within the handle. As the liver is depressed to release the tool, a tooth projecting from behind the pivot on the lever in gauge is the shank and helps to push the shank out of the handle.

U.S. Pat. No. 1,361,021 discloses a tool holder. The spring biased, pivoting retaining member includes two arms add a 90° angle from each other. Each of these arms includes a retaining hook. A stud is disposed opposite each of the retaining hooks. The shank of each tool includes a cut out to receive a retaining hook on one side and a stud on the other side, to retain a tool. A tool can be retained either parallel or perpendicular to the handle.

U.S. Pat. No. 1,500,402 discloses a knife. The handle includes a pair of side plates that are spaced apart by a short filler plate and a longer, L-shaped filler plate. The filler plates to find an opening at the front of the handle. A spring member is also disposed between the side plates. The spring number is rigidly or pivotally supported by a pin. The L-shaped filler plate includes one or more notches for receiving a lateral projection from the tank or shank of the blade. The shank or tang of the blade is tapered to facilitate insertion into the handle. Installing a blade requires only pushing the tang or shank of the blade into the handle until the projection engages the notch. Upward pressure against the spring member permits release of the blade from the handle. If multiple notches are provided for receiving the projection on the shank of the blade, then the effective length of the blade can be varied.

U.S. Pat. No. 1,586,906 discloses a knife or cutter. When embodiment includes a handle made from a pair of side plates and a filler plate defining a recessed therein. A resilient locking bar is secured at the back end of the recess, with its free end towards the front end of the recess. The filler plate includes a bearing surface which defines a shoulder. The tang of the blade is tapered so that it can fit between the locking bar in the bearing surface, until a lug on the tang extends around the shoulder. In this position, the locking bar secures the shank in place. Rotating the blade in the direction of its cutting edge pushes upward on the locking bar, allowing the blade to be removed from the handle. Another environment includes a reciprocal locking plate within the recess, which is spring biased towards the opening of the recess. The locking plate includes a surface that engages the tank of the blade to hold the lug engagement with the shoulder when the locking plate is in its forward position. An operating pin projecting outward through a slot can be engaged by the user's finger to retract the locking plate rearward, releasing the blade.

U.S. Pat. No. 1,813,723 discloses a knife. The blade includes a tapering shank terminating in a circular enlargement or projection. The handle includes a pivotally secured T-shaped locking member having one end that receives the circular projection on the shank. The other end is spring biased outward to push the shank engaging end inward. Depressing the spring biased end releases the blade.

U.S. Pat. No. 1,940,855 discloses a knife. The handle of the knife includes a retaining spring having an angular portion at its forward end. A plunger is provided on the opposite side of the handle to push the retaining spring away from the handle to release the knife. The tang of the knife includes a pair of arms defining a space there between. A pair of cross pins in the handle fit within the space between the arms. A notch with in one of these arms receives the angular portion of the retaining spring.

FR 2876940 discloses a fixed blade knife having a detachable blade. The knife is intended for use in the kitchen, so that the handle can be detached from the blade prior to cleaning the blade in a dishwasher, thus preventing deterioration of the handle. The purpose is also to permit replacement of the blade or handle when one or the other is in need of replacement. The knife includes a blade having a tang that is substantially equal to the length of the handle. The tang includes a pair of notches, with one disposed adjacent to the blade, and a second disposed closer to the rear of the tang. Both notches are L-shaped, and are oriented with the opening of each notch positioned farthest from the sharpened portion of the blade. The end of the tank defines a U-shaped cut out. One side of the U-shaped cut out, on the same side of the tang is the opening of the notches, forms a leaf spring. The handle includes a pair of side portions connected by a pair of pins that fit within the notches on the tang. Another pin forms a pivot for a locking lever. The locking lever includes a first and having anal hook that is structured to fit within the notch on the tank adjacent to the sharpen portion of the blade. The other end of the locking lever is V-shaped, with one side of the V-shaped forming a leaf spring. The pivot for the locking lever is adjacent to the V-shaped end. A cam is pivotally secured within the handle, an protrudes partially from the end of the handle. The cam includes a pair of wings that are structured to receive the rigid side of the V shaped end of the locking lever. The leaf springs exert pressure on the cam to hold the cam in either the open or closed position. Rotation of the cam pivots the locking lever between a closed position in which the blade is secured, and an open position in which the blade can be inserted or removed.

U.S. Pat. No. 1,998,188 discloses a knife handle. The knife handle includes a locking lever having an eccentric, circular portion around its pivot point. The eccentric circular portion engages a notch within the shank when the lever is against the handle. Pivoting the lever away from the handle brings the eccentric, circular portion out of the notch, releasing the blade.

U.S. Pat. No. 2,018,603 discloses a combination knife and axe. Both a knife blade and axe include a tang having a slot that is perpendicular to the handle, and a rounded back end. One edge of the handle includes a locking lever that is pivotally secured near the rear of the handle. The opposite edge includes a spring member. The spring member is secured at the forward edge of the handle by a fixed rivet pin passing through a slot, permitting some movement of the forward edge of the spring member. The rear end of the spring member contacts the locking lever to hold the locking lever in a closed position. To remove a tool, the locking lever is pivoted outward against the spring pressure. The blade or axe can then be rotated so that it is perpendicular to the handle, at which point the slot within the tang of the blade or axe can be slid off of the retaining pin within the handle.

U.S. Pat. No. 4,169,312 discloses a knife with interchangeable blades. The blade includes a tang having an upper recess and a lower recess. The handle includes a tension fork and a spacer, forming an opening therebetween at the front end of the handle. The tension fork includes an outer arm and an inner arm. The outer arm extends along the entire length of the handle. The inner arm defines a contact surface that interfaces with a camming surface on the lever. The lever is pivotally attached at the rear of the knife, and includes a locking point that is structured interface with the lower recess on the tang. The interaction between the end of the tension fork's inner arm and the camming surface on the lever holds the lever in the closed position.

U.S. Pat. No. 4,391,043 discloses a knife with removable blades. The knife blade includes a tang having a notch as well as an angled shoulder behind the notch. The handle defines a socket between the side plates and the forward end of the guide spacer plate. A locking plate is pivotally mounted along one edge of the knife. The back end of the locking plate is biased outward by a leaf spring between the locking plate and guide spacer plate. The forward end of the locking plate includes a locking tab that fits within the notch on the blade tang. When the blade is inserted into the handle, the angled surface on the tang would push the locking plate out of the way in till the locking tab is aligned with the notch. The guide spacer plate includes an angled surface which, when the blade is fully inserted, abuts the angled surface of the tang to increase the rigidity with which the blade is held within the handle. Depressing the backend of the locking plate releases the knife.

U.S. Pat. No. 6,701,626 discloses a hand tool with a changeable blade. The blade includes a tang having a straight front edge and a plurality of teeth defined on the back edge. The back end of the tang includes a rear end formation that is bent slightly to one side. The handle is formed from two symmetrically identical side parts which include a surface for interfacing with the flat part of the tang. A lever is pivotally mounted at the forward end of the handle. The lever includes a plurality of teeth that interface with the teeth on the tang. The lever includes a projecting locking arm formation that engages behind the rear end formation of the blade tang. The locking arm formation and the back end of the tang bear elastically on one another to hold the lever in a closed position.

U.S. Pat. No. 7,325,314 discloses a hand saw having a replaceable blade. The blade includes a pair of hooks, with one hook adjacent to the cutting edge, and one hook adjacent to the back edge. The hook adjacent to the cutting edge fits over a locking pin in the handle. The hook adjacent to the back edge of the blade is engaged by a locking groove of a press button. The press button is pivotally secured within the handle, with a spring biasing the opposite end of the press button outward. Pressing the button in against the spring raises the hook out of engagement with the blade, permitting release of the blade.

US 2017/0348863 discloses a folding knife with interchangeable blades. The knife includes a handle to which a latch is pivotally secured so that the latch may rotate between an open and closed position. The latch includes a pair of side plates defining a slot therebetween for receiving the blade. The latching portion of the blade includes a latch spine, a spine notch, and a longitudinal notch. The longitudinal notch receives a pin that is secured between the latch plates. The spine notch receives the latch hook at the forward end of a rocker. The rocker is pivotally secured between the latch plates, and is spring biased into the spine notch by a spring at the opposite end of the rocker. A spring biased lock pin is disposed under the rocker, between the pivot and the spring. The lock pin includes a nut at one end and a button at the opposite end. The lock pin is spring biased so that the button is biased outward, and the nut is biased underneath the rocker to resist movement of the rocker. Depressing the button moves the nut out of the path of the rocker, permitting the rocker to be depressed to release the knife blade.

The Leatherman Leap includes a knife blade that is separate from the rest of the tool at the time of purchase, and can be snapped into place when desired by the user. The blade is not designed to be removed once it is installed.

U.S. Pat. No. 7,469,476, which was issued to Andrew Demko on Dec. 30, 2008 and assigned to Cold Steel, Inc., discloses a locking device for a folding knife. The knife has a blade secured to a handle using a hinge pin. A locking bar is pivotally secured within the handle by a pivot pin, and is spring biased towards the locked position by a spring. The shank portion of the blade includes an arcuate end edge defining a shank hook formed therein. The locking bar includes a notched end portion that engages the shank hook in the open, locked position. A safety reinforcement pin extends between the frame elements of the handle. When the knife is in the locked position, the pin abuts the forward edge portion of the shank of the blade, and the engagement surface of the end portion of the locking bar. While this lock is known to have enhanced strength as compared to prior locks, it has only been utilized with folding knives. The entire disclosure of this patent is expressly incorporated herein by reference.

An interchangeable fixed blade knife would be significantly more useful and appealing with increased strength, combining the traditional advantage of a fixed blade knife with the flexibility of interchangeable blades. Additionally, in the unlikely event of lock failure, a structure that catches the blade prior to the edge contacting and cutting the user's fingers would add to the usefulness and desirability of such a knife.

SUMMARY

The above needs are met by a knife comprising a blade having a shank. The shank has a first side and a second side, with a locking projection extending outward from the first side. The blade further defines a support surface adjacent to the second side of the shank. The knife has a handle having a pair of handle sides. The handle defines a shank-receiving recess between the handle sides. The handle further has a blade support corresponding to the support surface adjacent to the second side of the shank. The knife further comprises a lock bar pivotally secured between the handle sides. The lock bar has a hook extending therefrom, with the hook including a bottom surface, a first side surface extending upwardly therefrom, and a second side surface extending upwardly therefrom. The lock bar is movable between a locked position wherein the first surface of the hook abuts the locking projection of the shank, and an unlocked position wherein the first surface of the hook is disengaged from the shank. The lock bar is spring-biased towards the locked position. The knife also has a lock pin extending between the handle sides adjacent to the blade receiving recess. The lock pin is disposed between and abuts the second surface of the hook and the blade back surface when the blade is within the blade receiving recess and the lock bar is in the locked position. The lock pin is dimensioned and configured so that upon rotation of the blade about the blade support, the lock projection will abut the lock pin, resisting further rotation of the blade.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
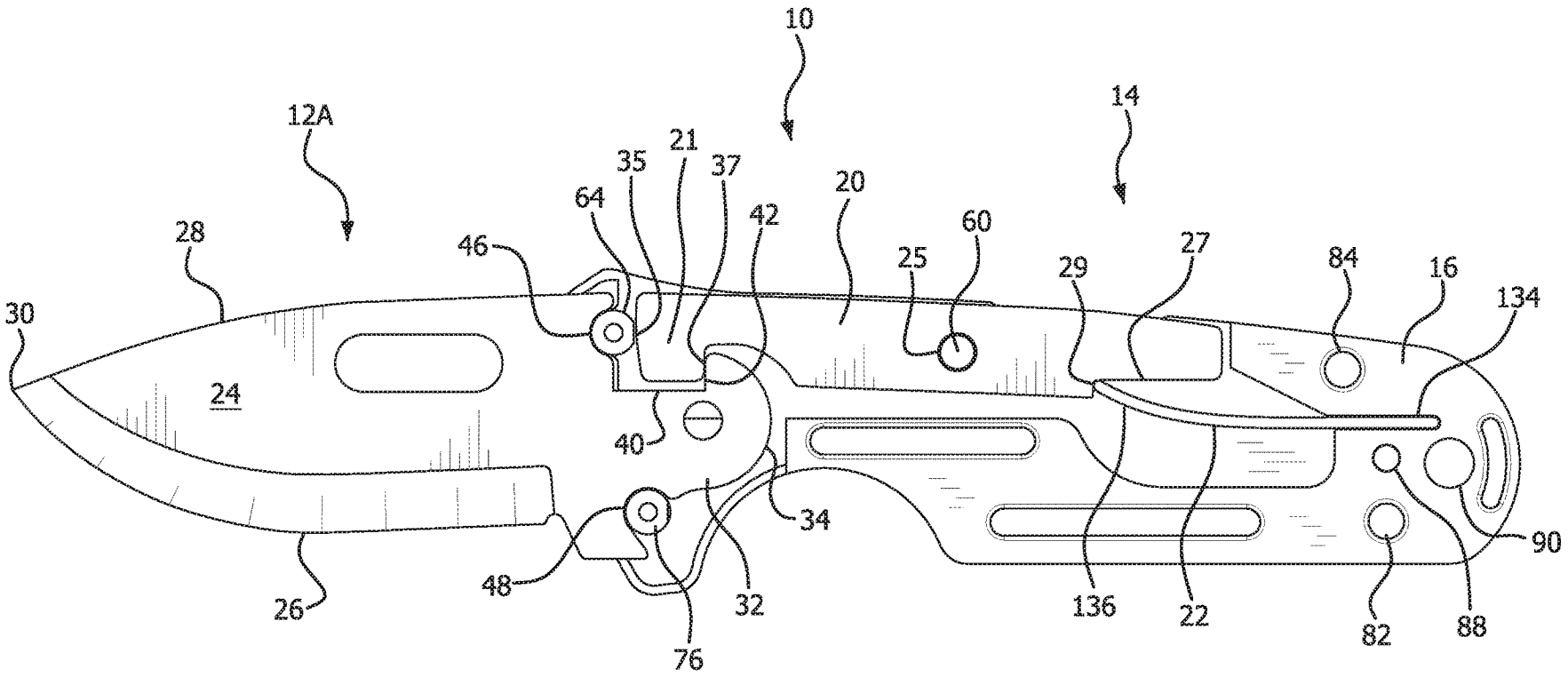
FIG. 1 is a side elevational view of a knife, with one handle panel removed.

Referring to the drawings, a knife 10 is illustrated. As shown in FIG. 1, the knife 10 has a plurality of blades 12, with the reference character 12 referring to a blade in general, and 12A, 12B, etc. referring to specific blades. The knife 10 also includes a handle 14 having first and second panels 16, 18, respectively. In most of the Figures, the handle panel 18 is removed for clarity. A lock bar 20 is pivotally secured between the handle panels 16, 18, and is spring-biased towards a locked position by a leaf spring 22 as described in greater detail herein.

Figure 2:
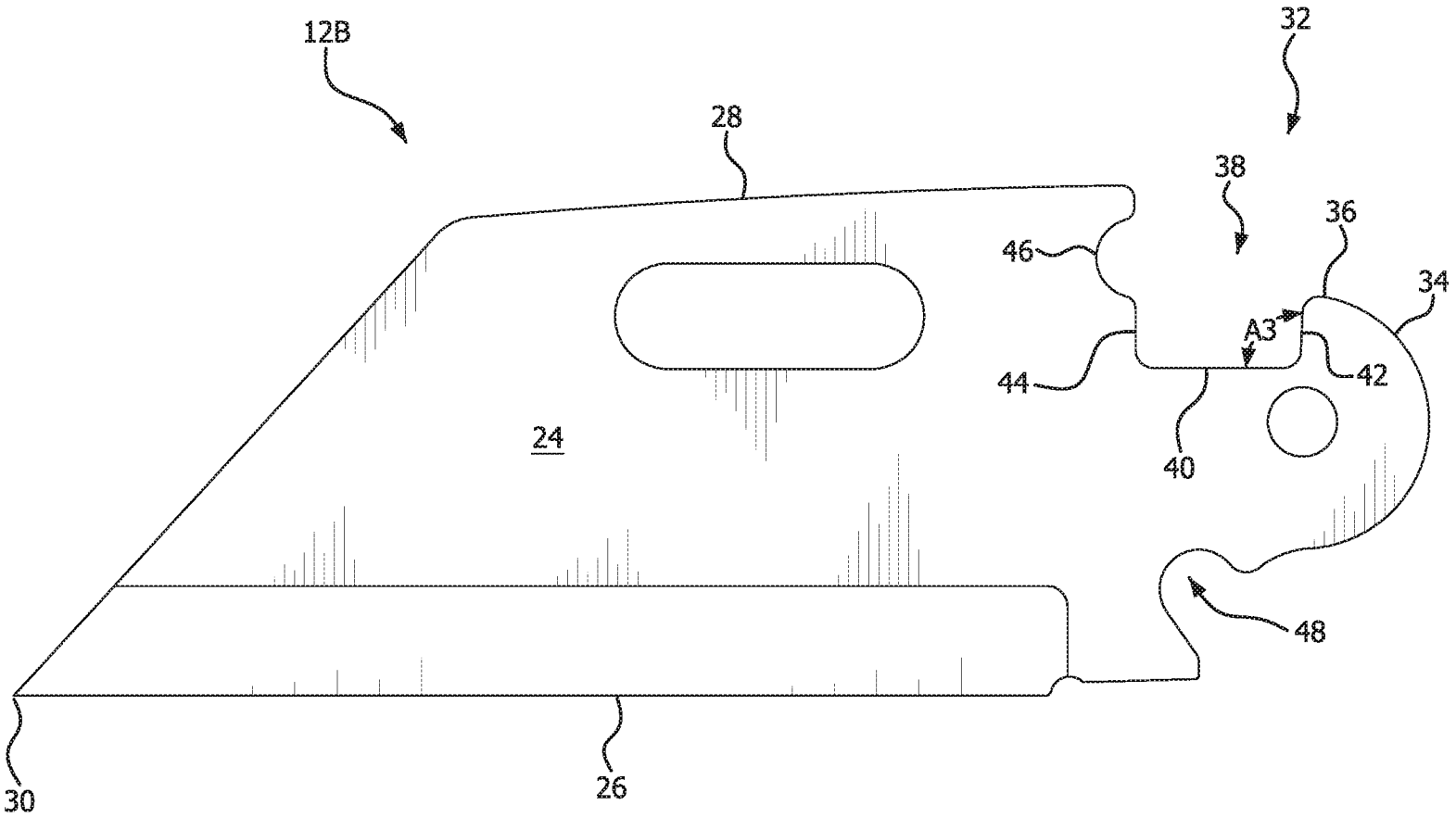
FIG. 2 is a side elevational view of a blade for the knife of FIG. 1.

Referring to FIGS. 1-2, the blade 12A, 12B includes a body 24 having a cutting edge 26, a spine 28, and a tip or point 30 (not all blade tips will include points). Other blade styles that omit, modify, or substitute some features, for example, sheep's foot blades, gut hooks, plain edge and serrated edge blades, hawk bill blades, and the like, may all be used without departing from the invention. The common feature of all of the blade 12 is the shank 32. The shank 32, disposed opposite the tip or point 30, includes a convex curved edge surface 34 at its proximal end, providing the shank 32 with a tapered profile. The portion of the shank 32 corresponding to the spine 28 includes a locking projection or hook 36, with a lock bar receiving recess 38 defined between the hook 36 and the body 24. The lock receiving recess 38 includes a bottom surface 40, an upwardly extending surface 42 corresponding to the hook 34, and an upwardly extending blade back surface 44, corresponding to the body 24. The upwardly extending surface 44 includes a recess 46 for receiving a lock pin that will be described in greater detail below. The angle A3, formed between the surfaces 40, 42, is equal to or slightly less than 90° in the illustrated example. The side of the shank 32 corresponding to the edge 26 defines a support surface, which in the illustrated example is a support pin receiving recess 48, for abutting a blade support pin that will be described in greater detail below.

Figure 3:
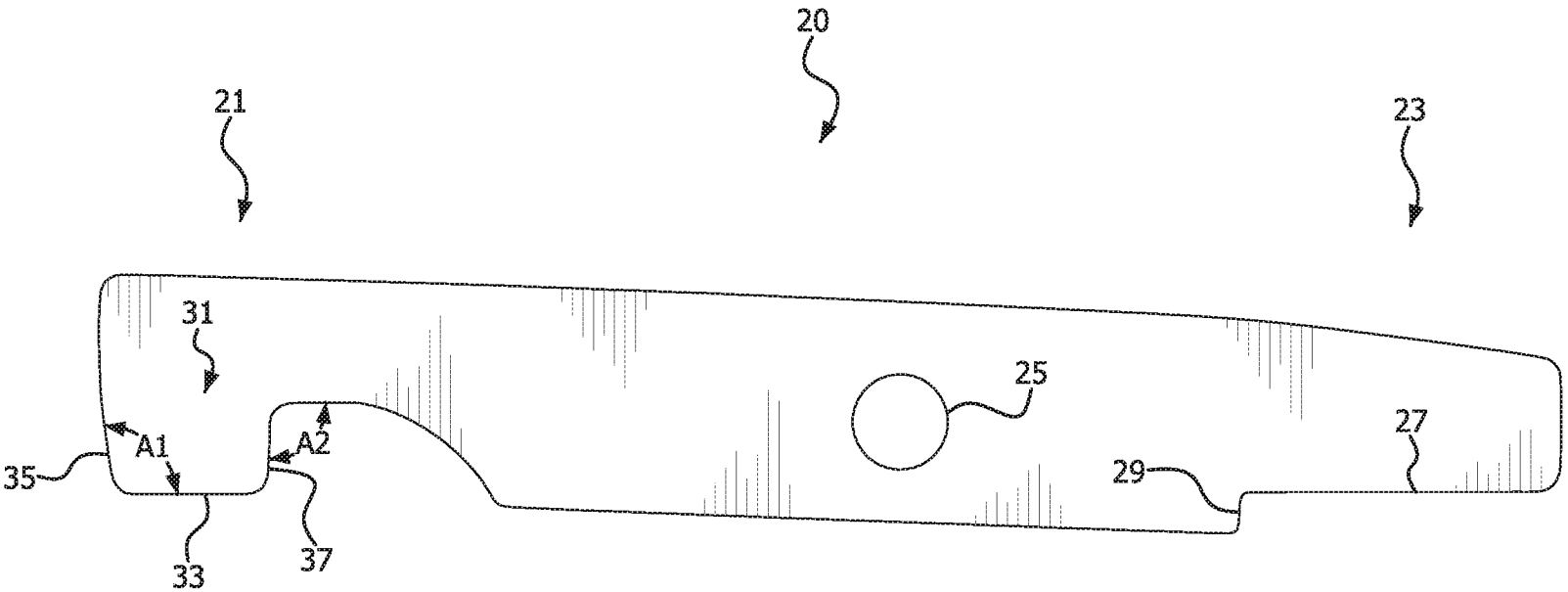
FIG. 3 is a side elevational view of a lock bar for the knife of FIG. 1.
Figure 7:
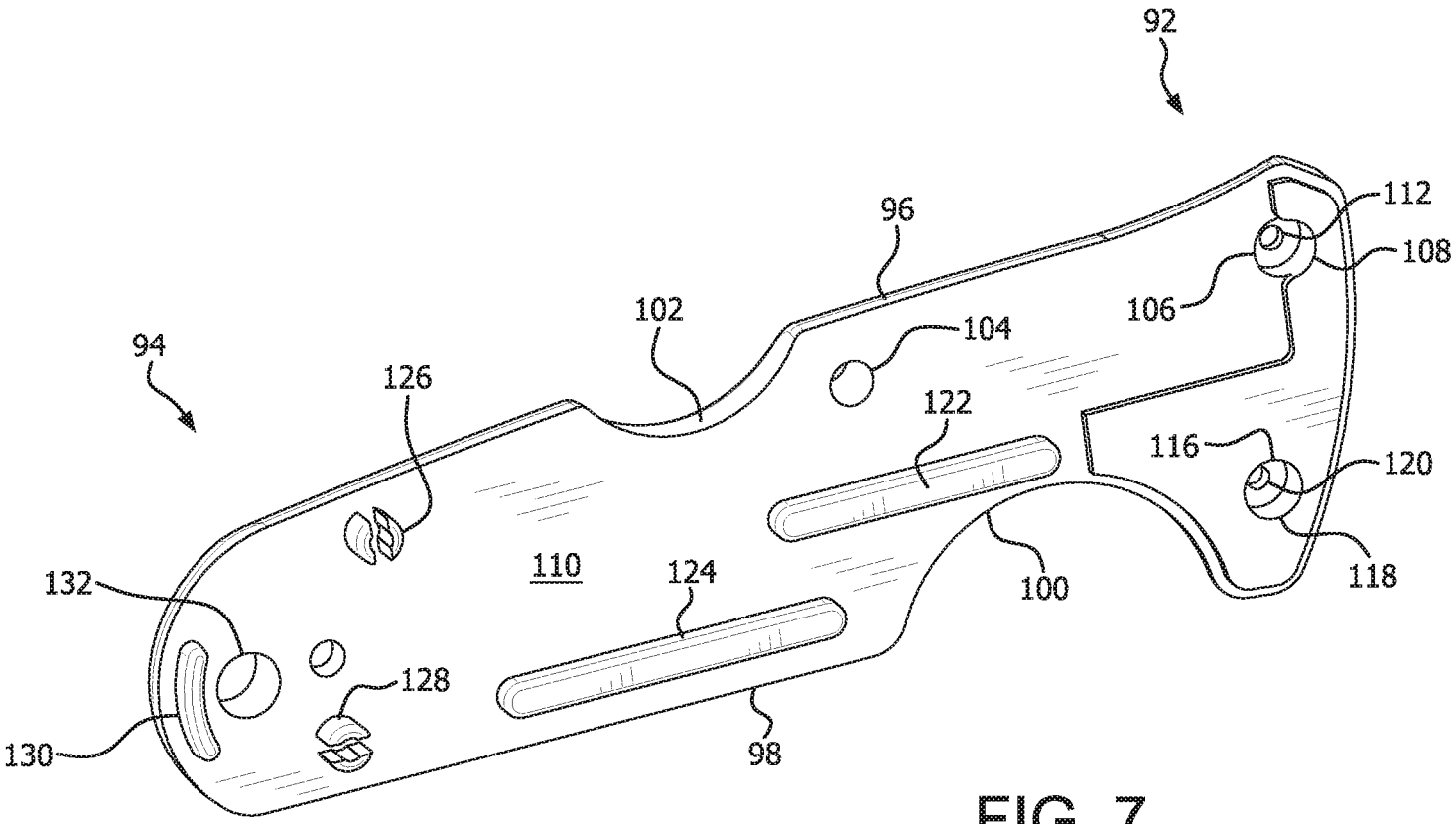
FIG. 7 is a perspective view of a second handle side panel for the knife of FIG. 1.

Referring to FIGS. 1 and 3, the lock bar 20 is illustrated. The lock bar 20 includes a distal end 21 and a proximal end 23. A pivot hole 25 is located between the distal end 21 and proximal and 23, and in the illustrated example is centrally located on the lock bar 20. In some examples, the pivot hole 25 may be elongated as illustrated in FIG. 7 of U.S. Pat. No. 7,469,476. Other examples of the pivot hole 25 may be slightly larger than the pivot pin 60. The proximal end 23 of the lock bar 20 includes a spring support surface 27 and a spring stop surface 29, which in the illustrated example is substantially perpendicular to the spring support surface 27. The distal end 21 includes a downwardly projecting hook 31 defined by a lower surface 33 and a pair of upwardly projecting surfaces 35, 37 on either side of the hook 31. The surface 35 in the illustrated example includes a slight convex curvature. In the illustrated example, the angle A1 is slightly greater than 90°, and the angle A2 is slightly less or equal to 90°. The angles A2, A3 are selected so that the surfaces 37, 42 are substantially parallel when the blade 12 is locked in position as described below.

Figure 4:
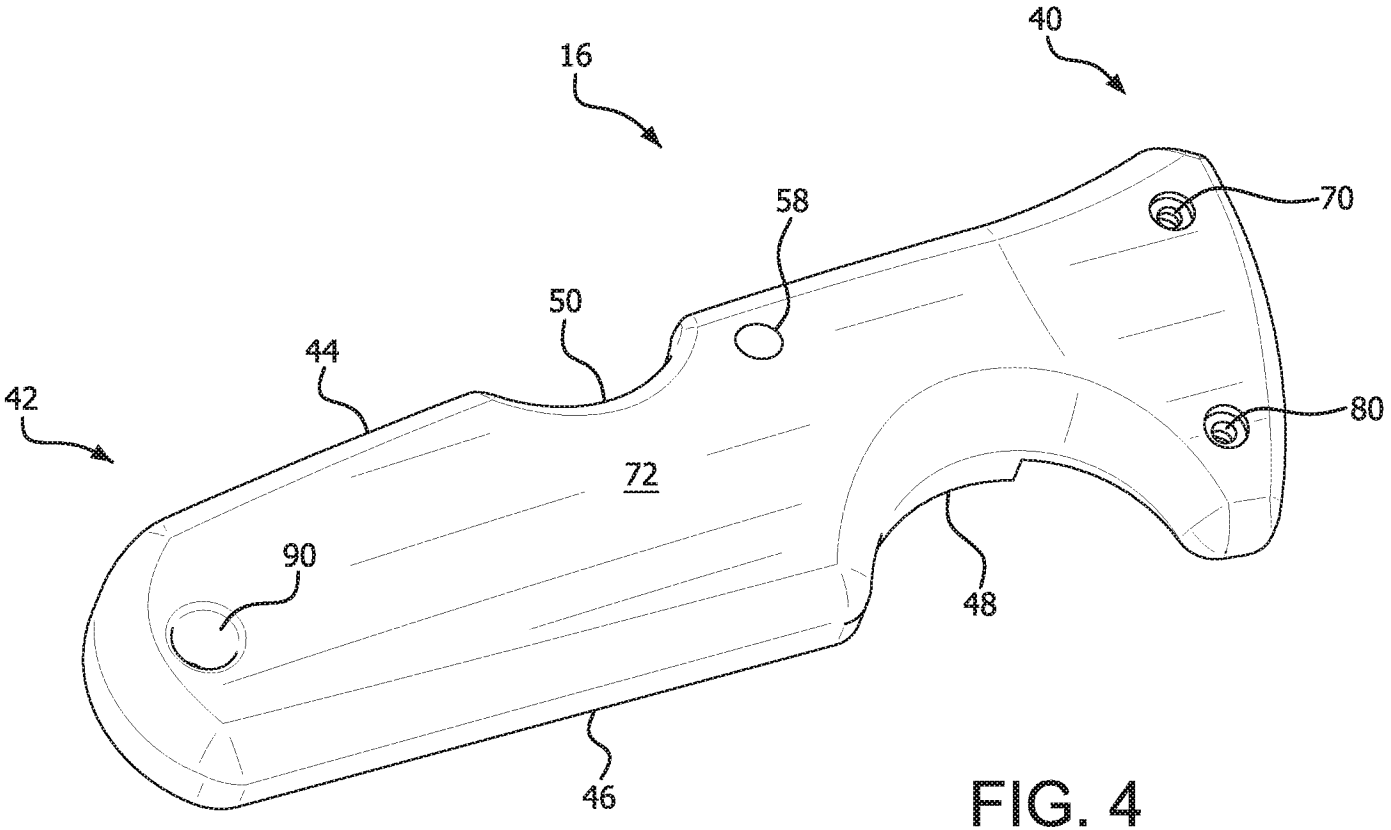
FIG. 4 is a perspective view of a first handle side panel for the knife of FIG. 1.
Figure 5:
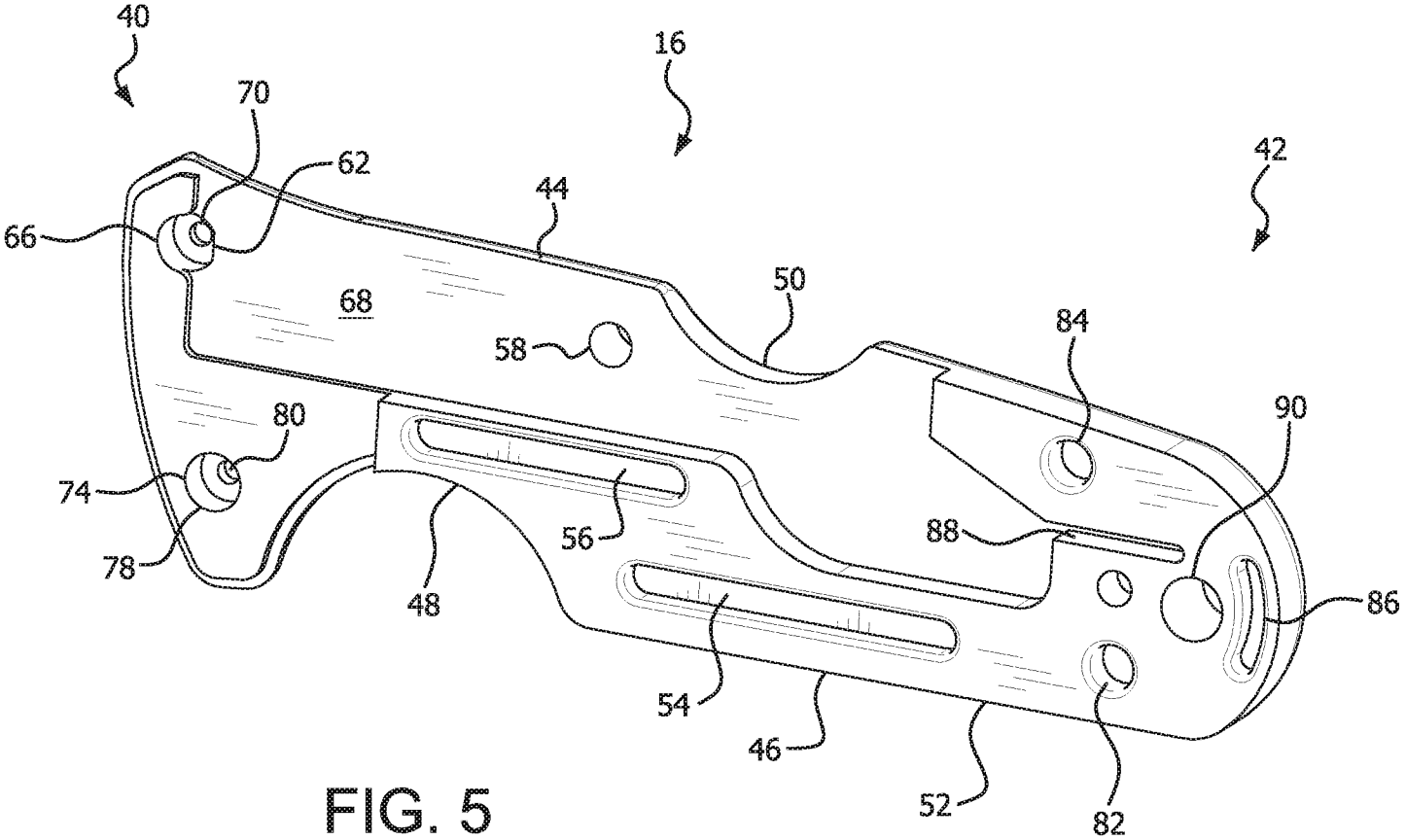
FIG. 5 is a perspective view of a first handle side panel for the knife of FIG. 1.

The first panel 16 of the handle 14 is illustrated in FIGS. 1 and 4-5. The panel 16 includes a distal end 40 and the proximal end 42. The back edge 44 and front edge 46 extends between the distal end 40 and proximal end 42. The front edge 46 in the illustrated example includes a finger groove 48 for receiving the index finger of the user, thus securing the knife 10 within the user's grip. The back edge 44 includes a recess 50 to facilitate depression of the lock bar 20. The front edge 46 also includes a female interlocking projection 52, which in the illustrated example defines a pair of slots 54, 56. A pivot pin hole 58 is defined centrally, and proximate to the back edge 44, for receiving the pivot pin 60 for the lock bar 20. Some examples of the pivot pin hole 58 may have a larger diameter than the pivot pin 60, or may be elongated in a direction extending between the distal and proximal ends of the panel 16. A hole 62 is defined in the distal end 40, proximate to the rear edge 44, for receiving the lock pin 64. The illustrated example of the hole 62 is counterbored, including a larger diameter portion 66 on the inner side 68, and a smaller diameter portion 70 on the outer side 72. A support pin aperture 74 is also defined within the distal end 40, proximate to the front edge 46. The support pin aperture 74, for receiving the support pin 76, also includes a larger diameter portion 78 adjacent to the inside surface 68, and a smaller diameter portion 80 adjacent to the outer surface 72. The interlocking projection 52 extends around the distal end 42 of the panel 16, defining apertures 82, 84 as well as slot 86 for receiving corresponding projections on the handle 18 are described below. The interlocking projection 52 also defines a channel 88 for receiving the leaf spring 22 therein. In the illustrated example, a lanyard hole 90 extends through the proximal end 42.

Figure 6:
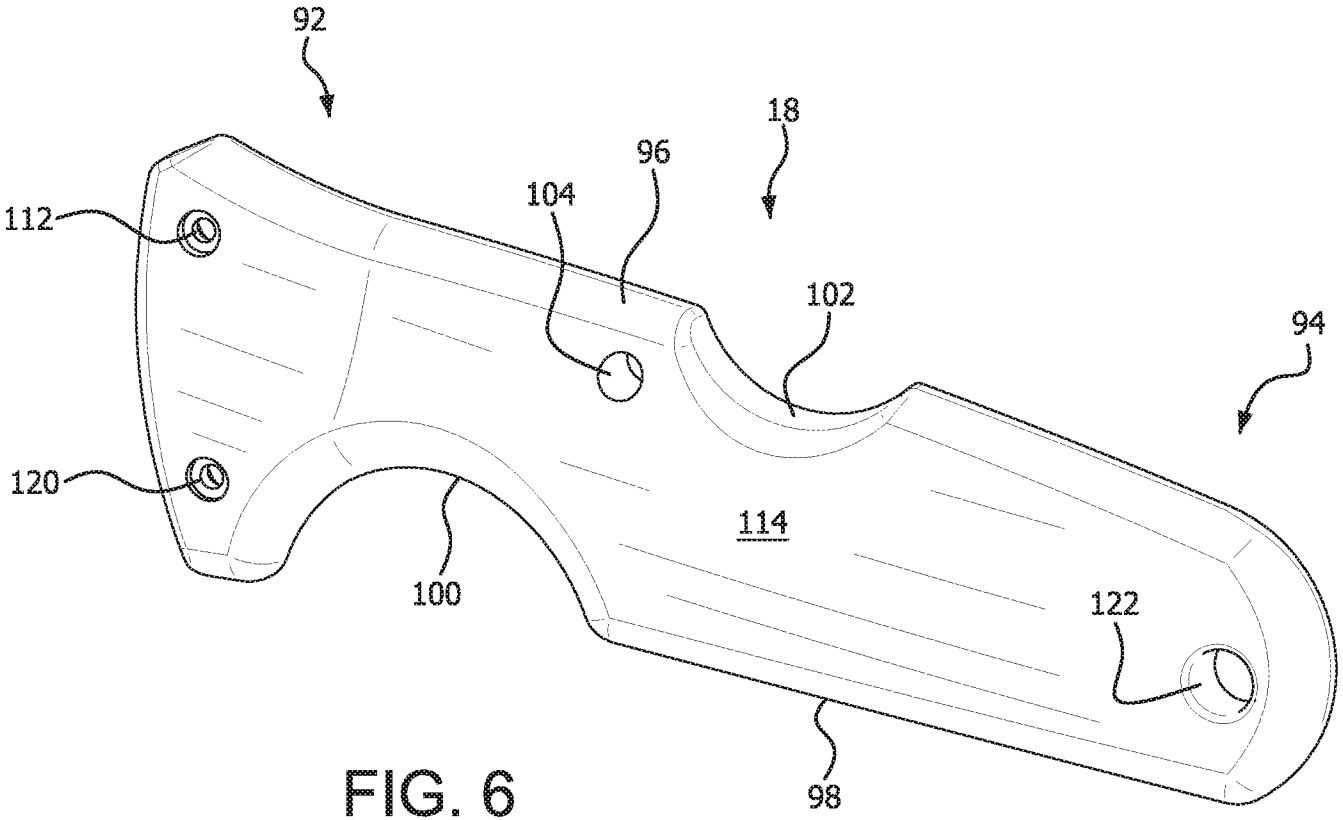
FIG. 6 is a perspective view of a second handle side panel for the knife of FIG. 1.

The second handle panel 18 is illustrated in FIGS. 6-7. The second handle panel 18 is in some respects a mirror image of the first handle panel 16. The second handle panel 18 includes a distal end 92 and proximal end 94, corresponding to the distal end 40 and proximal end 42 of the first panel 16. The panel 18 further includes a back edge 96 and front edge 98 corresponding to the back edge 44 and front edge 46 of the panel 16. The front edge 98 includes a finger groove 100 corresponding to the finger groove 48, and the back edge 96 includes a recess 102 corresponding to the recess 50 of the panel 16. A lock pivot hole 104 is defined centrally on the panel 18, adjacent to the back edge 96, so that when the panel 16, 18 are joined together, the holes 58, 104 will be substantially coaxial. Some examples of the pivot pin hole 104 may have a larger diameter than the pivot pin 60, or may be elongated in a direction extending between the distal and proximal ends of the panel 18. Similarly, the support pin hole 106 is substantially coaxial with the whole 62, and also includes a larger portion 108 corresponding to the inner surface 110 of the panel 18, and a smaller diameter portion 112 corresponding to the outer surface 114 of the panel 18. Similarly, the blade support pinhole 116 is positioned to be substantially coaxial with the whole 74 of the panel 16. The support pinhole 116 also includes a large diameter portion 118 corresponding to the inner surface 112, and a smaller diameter portion 120 corresponding to the outer surface 114. The inner surface 110 also includes projection 122 that is dimensioned and configured to fit within the slot 56. Similarly, the projection 124 is dimensioned and configured to fit within a slot 54. Projections 126, 128 are dimensioned and configured to fit within the holes 84, 82, respectively. Projection 130 is dimensioned and configured to fit within a slot 86. In the illustrated example a lanyard hole 132 is positioned to be substantially coaxial with the hole 90.

Referring back to FIG. 1, the handle 14 is assembled by placing the lock pivot pin 60 within the aperture 58 of the panel 16. The lock pin 64 is placed within the aperture 62. The blade support pin 76 is placed within the apertures 74 of the panel 16. The lock bar 20 is positioned so that the pin 60 passes through the aperture 25, and so that the hook 31 corresponds to the distal end 40 of the panel 16. The spring 22 is positioned with one and 134 within the slot 88, and the opposite end 136 abutting the intersection between the spring support surface 27 and spring stop 29. The panel 18 is then joined to this assembly, with the lock pin 64 passing into the aperture 106, the blade support pin 76 passing into the aperture 116, and the lock pivot pin 60 passing into the aperture 104. The projections 122, 124, 126, 128, and 130 are simultaneously inserted into the slots 56, 54, holes 84, 82, and slot 86, respectively. At this point, the handle 14 is ready to removably secure any desired blade 12 within the recess within the distal end of the handle in the manner described below.

Figure 8:
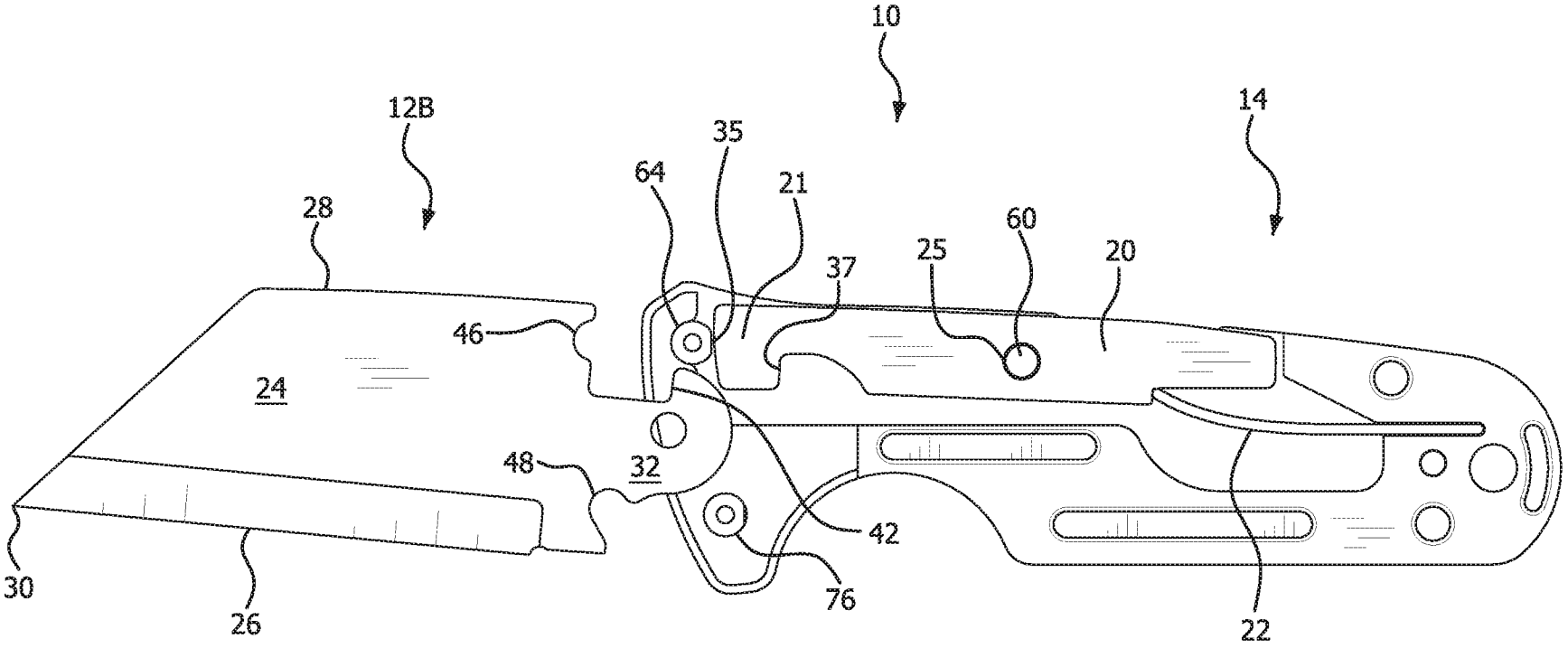
FIG. 8 is a side elevational view of a first step of inserting a blade into the handle of a knife of FIG. 1.
Figure 9:
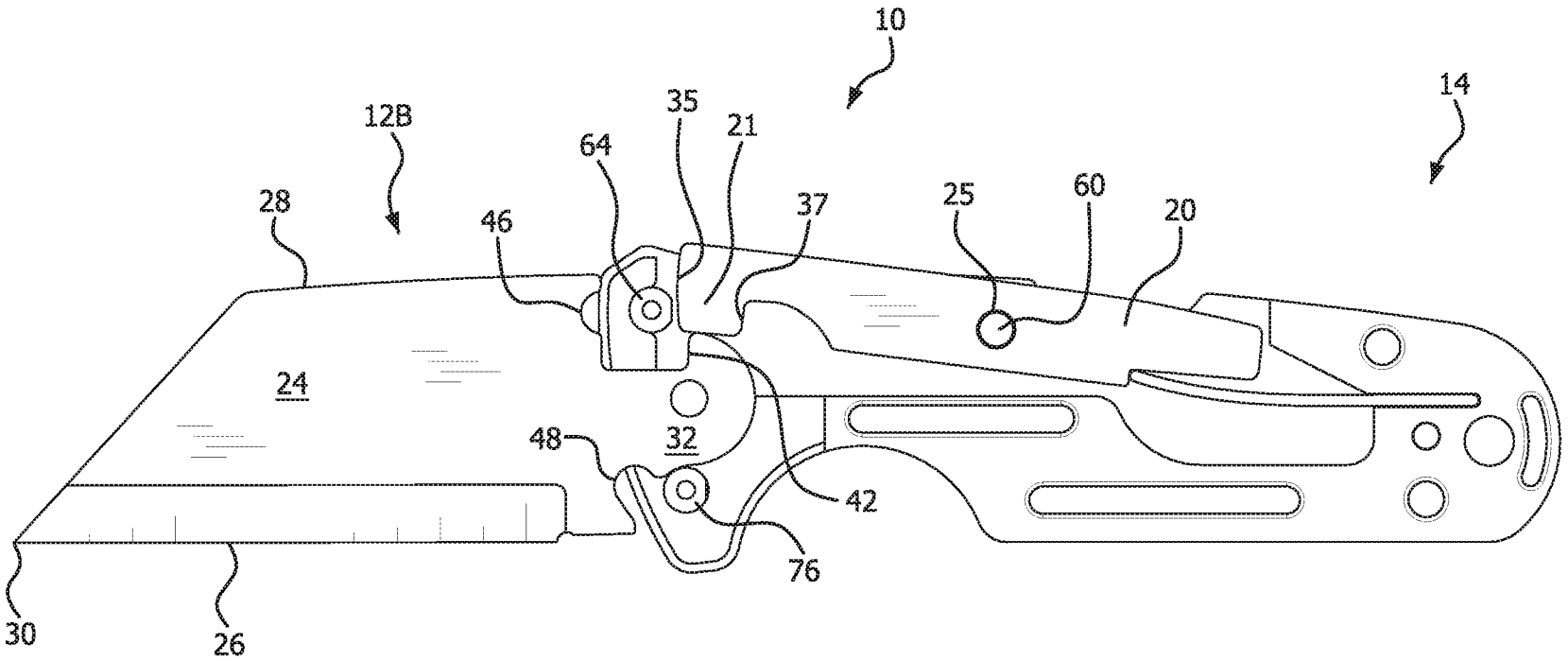
FIG. 9 is a side elevational view of a second step of inserting a blade into the handle of a knife of FIG. 1.

Although the panel 18 will typically be in place during installation and removal of the blade 12, panel 18 has been removed from FIGS. 8 and 9 for clarity. As shown in FIG. 8, the shank 32 of any desired blade 12 can be inserted between the distal ends 40, 92 of the panel 16, 18, respectively. As shown in FIG. 9, the convex curved surface 34 and resulting tapered profile will direct the shank 32 upward, with the same curved surface 34 pushing the hook 31 of the lock bar 20 upward to permit passage of the shank 32 completely into the handle 14, until it reaches the position illustrated in FIG. 1. In this position, with the hook 36 completely past the hook 31, the hook 31 is biased into the recess 38, with the surface 37 of the lock bar 20 abutting the surface 42 of the blade 12, and the surface 35 of the lock bar 20 abutting the lock pin 64. The blade support pin 76 is within the recess 48 on the blade 12, providing support for the side of the blade 12 having the edge 26. The lock pin 64 is within the recess 64, supporting the side of the blade adjacent to the spine 28. Depressing the proximal end 23 of the lock bar 20 disengages the hook 31 from the hook 36, permitting removal of the blade 12 from the handle 14.

The lock pin 64 provides two different advantages to the knife 10: strengthening the lock, and providing a safety catch in the very unlikely event of lock failure. With the hook 31 wedged between the hook 36 and lock pin 64, pressure on the cutting edge 26 of the blade 12 is resisted by the lock pin 64 rather than the pivot pin 60. Similarly, pressure on the spine 28 of the blade 12 causes the hook 36 to push the hook 31 into the lock pin 64, so that this force is also resisted by the lock pin 64 rather than the pivot pin 60. Given the distance between the blade 12 and pivot pin 60, any forces applied at an angle could potentially create leverage that would increase the amount of force applied to the pin 60. Resisting these forces closer to the blade 12 with the pin 64 minimizes the likelihood of such force-multiplying leverage exceeding the strength of a pin. Additionally, when the hook 31 is wedged between the hook 36 and pin 64, the surface 33 of the lock bar 20 will ordinarily not be in contact with the surface 40 of the blade. The angles of the surfaces 35, 37 of the lock bar 10 are such that the hook 31 tapers to a narrower width as the surface 33 is approached. As the knife 10 is used repeatedly and the various components are subject to wear, the hook 31 may pass farther into the recess 38 to compensate for wear.

Figure 10:
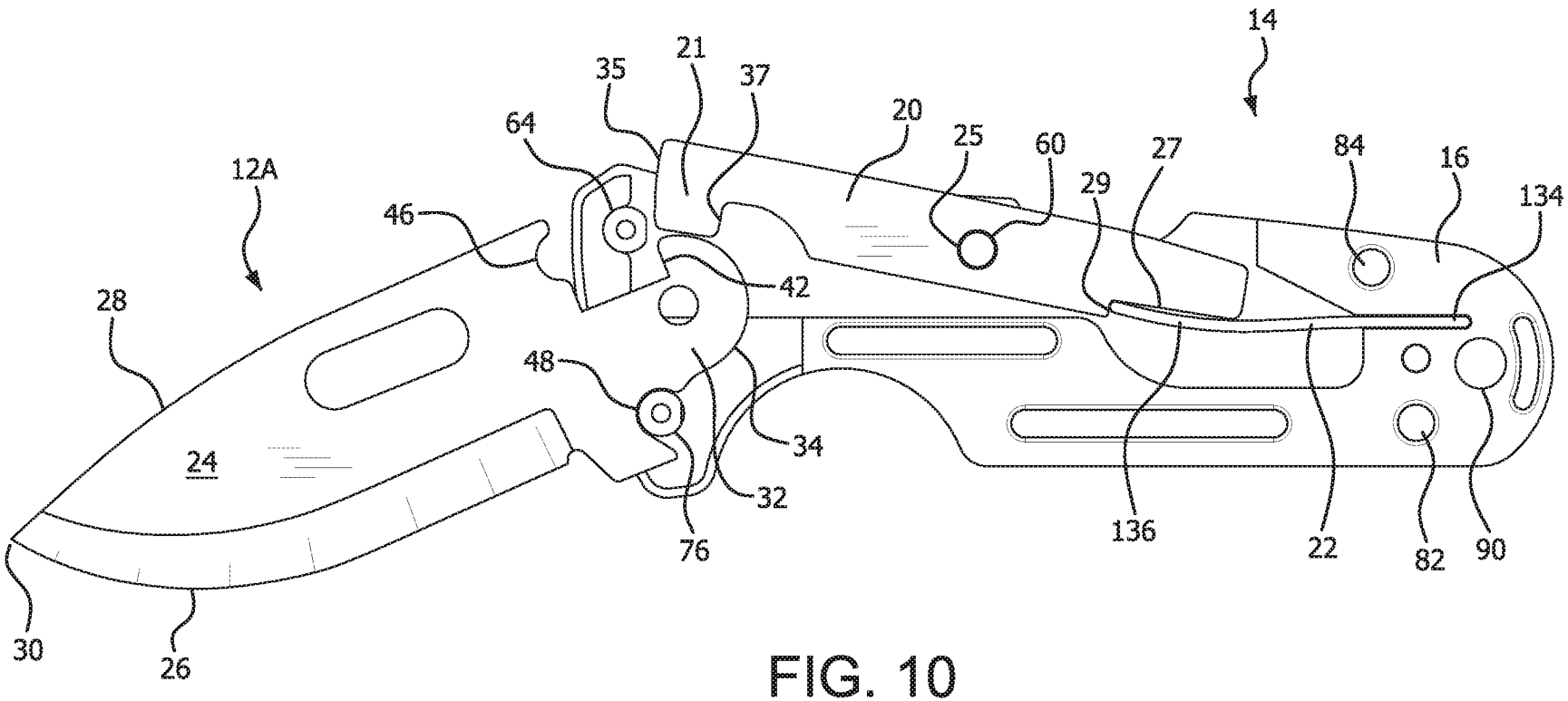
FIG. 10 is a side elevational view of a knife of FIG. 1, showing how the blade is intercepted prior to contacting a user's fingers in the unlikely event of lock failure.

The second advantage is best illustrated in FIG. 10. In the very unlikely event of lock failure, the blade 12 will rotate around the blade support pin 76 until the hook 36 abuts the lock pin 64. Pin 64 thereby resists additional rotation of the cutting edge 26 towards the fingers of the user. Pin 64 thus functions not only as a lock strengthening pin, but also as a safety catch.

The present invention therefore provides a fixed blade knife having interchangeable blades. The knife includes a particularly strong blade retention mechanism. The knife also includes a safety catch that resists rotation of the blade to a position in which the user's fingers would be injured in the unlikely event of lock failure.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A knife, comprising:

a blade having a shank, the shank having a proximal end defining a convex curved edge surface, the shank having a first shank side and a second shank side, with a locking projection extending upward from the first shank side, the blade further having a blade back surface extending upward from the shank; the blade further defining a support surface adjacent to the second shank side;

a handle having a pair of handle sides, the handle defining a shank-receiving recess between the handle sides, the handle further having a blade support pin extending between the handle sides and corresponding to the support surface adjacent to the second shank side;

a lock bar pivotally secured between the handle sides, the lock bar having a downwardly extending hook, the hook including a bottom surface, a first side surface extending upwardly from the bottom surface, and a second side surface extending upwardly from the bottom surface, the lock bar being movable between a locked position wherein the first side surface of the hook abuts the locking projection of the shank, and an unlocked position wherein the first side surface of the hook is disengaged from the locking projection of the shank, the lock bar being spring-biased towards the locked position;

a lock pin extending between the handle sides adjacent to the shank-receiving recess, the lock pin being disposed between and abutting the second side surface of the hook and the blade back surface when the shank is within the shank-receiving recess and the lock bar is in the locked position, the lock pin being dimensioned and configured so that upon rotation of the blade about the blade support pin to an angular position that is downward from an angular position in which the blade is retained by the lock bar, the locking projection will abut the lock pin, resisting further rotation of the blade.

* * * * *